US007128694B1

(12) United States Patent
Fulks

(10) Patent No.: US 7,128,694 B1
(45) Date of Patent: Oct. 31, 2006

(54) METHOD AND APPARATUS FOR BI-DIRECTIONAL EXERCISE MOVEMENTS

(76) Inventor: Kent Fulks, 9710 Amberly Dr., Dallas, TX (US) 75243

( * ) Notice: Subject to any disclaimer, the term of this patent is extended or adjusted under 35 U.S.C. 154(b) by 39 days.

(21) Appl. No.: 10/994,577

(22) Filed: Nov. 22, 2004

(51) Int. Cl.
*A63B 21/06* (2006.01)

(52) U.S. Cl. ..... 482/94; 482/95; 482/96; 482/148; 482/907

(58) Field of Classification Search ..... 482/45–46, 482/97, 139, 136–137; 601/40, 44
See application file for complete search history.

(56) References Cited

U.S. PATENT DOCUMENTS 5,562,577 A * 10/1996 Nichols et al. ..... 482/97
5,769,757 A 6/1998 Fulks
5,810,701 A 9/1998 Ellis et al.
6,387,023 B1 * 5/2002 Liga, Jr. ..... 482/130
6,394,936 B1 * 5/2002 Voris ..... 482/100
6,656,092 B1 12/2003 Fulks

* cited by examiner

*Primary Examiner*—Lori Amerson
(74) *Attorney, Agent, or Firm*—John F Bryan

(57) ABSTRACT

A machine for bi-directional exercising of a muscle group through movement of lever arms against a selected resistance has a sub-frame mounted to a main-frame, for pivotal movement about a generally horizontal axis, and the levers connected to the sub-frame to pivot on a pair of spaced apart right and left pivot axes axially displaced to provide a moment arm about the horizontal axis. The lever arms each have a pedal, oriented to effect pivotal movement of the sub-frame about the horizontal axis, and a knee pad, oriented to effect pivotal movement of the lever arms about their respective right or left pivot axis. Linkage members connect each lever arm to the main-frame so that, as the sub-frame pivots through a given angle, the lever arms pivot through opposing angles, and a force applied to either the pedals or knee pads will move the sub-frame and lever arms through their respective angular ranges.

7 Claims, 3 Drawing Sheets

METHOD AND APPARATUS FOR BI-DIRECTIONAL EXERCISE MOVEMENTS

TECHNICAL FIELD

This invention relates generally to exercise machines, and more particularly, to exercise machines wherein the user's movements are opposed by a selected weight.

BACKGROUND OF THE INVENTION

Many athletes and non-athletes utilize weight lifting or weight training exercises to build muscle strength and/or bulk, to prevent injury, or to improve overall condition and appearance. Typically, weight training exercises are performed with either exercise machines or free weights, i.e, barbells and weighted plates, dumbbells, etc.

Free weights offer certain advantages over exercise machines. For instance, they are relatively inexpensive in comparison to exercise machines. Free weights are also more versatile because a variety of exercises can be performed with one set of weights. On the other hand, exercise machines are usually designed for movement in a specific plane. The human body however, is by no means limited to such two dimensional movements. Thus, in an effort to replicate the benefits of multi-dimensional exercise activities, comprehensive exercise programs will incorporate both machines and free weights. In so doing, a variety of exercise routines are combined to work specific muscles and muscle groups in more than two dimensions for a more natural result.

The gluteus muscles, gluteus maximus and minimus are a compound muscle group commonly referred to as the "butt muscles". The gluteus maximus acts at the hip to pull the thigh downwardly into alignment with the upper body while the gluteus minimus is the hip abductor, acting to pull the thigh outwardly. Since these muscles act in such diverse directions, they exemplify a muscle group which cannot be exercised on any single prior art machine.

The object of the present invention therefore, is to provide a method and apparatus for bi-directional exercise of such compound muscle groups.

SUMMARY OF THE INVENTION

The present invention addresses the aforesaid object with improved exercise methods and apparatus. In accordance with the present invention, herein are disclosed exercise devices affording bi-directional resistance movements of the legs for exercise of the gluteus muscle group. It will be appreciated that the same methods may be employed in arm exercises for other muscle groups including the deltoids. The invention relates to or employs some steps and apparatus well known in the arts and therefore, not the subject of detailed discussion herein.

A preferred embodiment of the present invention utilizes barbell plates to provide an incrementally adjustable resistance. The apparatus has a conventional main-frame and a centrally mounted seat. A plane of symmetry extends through the middle of the frame and seat so that the two sides are mirror images with respect to a vertical mid-plane. A sub-frame pivots on a transverse horizontal axis at the upper ends of its "U" shape, where it is mounted to the main-frame. The sub-frame also includes right and left pivot axes oriented more or less perpendicularly to the horizontal axis and set at the bottom of the "U" where they are axially displaced from the horizontal axis. Right and left lever arms are mounted to pivot on these axes. Offset linkage members connect each lever arm to the main-frame so that, as the sub-frame pivots through a given angle, the lever arms pivot through opposing angles of the same order as the given angle. Each of the lever arms has an exercising force input location, oriented to effect pivotal movement of the sub-frame about the horizontal axis, and a second exercising force input location, oriented to effect pivotal movement of the lever arms about the right and left axes. In the present invention, the right and left pivot axes are axially displaced from the horizontal axis, so that lever arm pivotal reaction forces normal to the right and left pivot axes have a significant moment arm about the horizontal axis. As a result, the sub-frame can be pivoted about its horizontal axis by an exercising force applied to either, or both, input locations. This differs significantly from prior art teachings of an interconnecting linkage for arm exercises. In this prior art, the right and left axes are displaced radially, but not axially, from the horizontal axis, so that there is no moment arm similar to the present invention. Lacking this moment arm, bi-directional exercise movements are not possible.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Note that, throughout the FIGURES, like reference numbers are used to denote the same parts.

Figure 1:
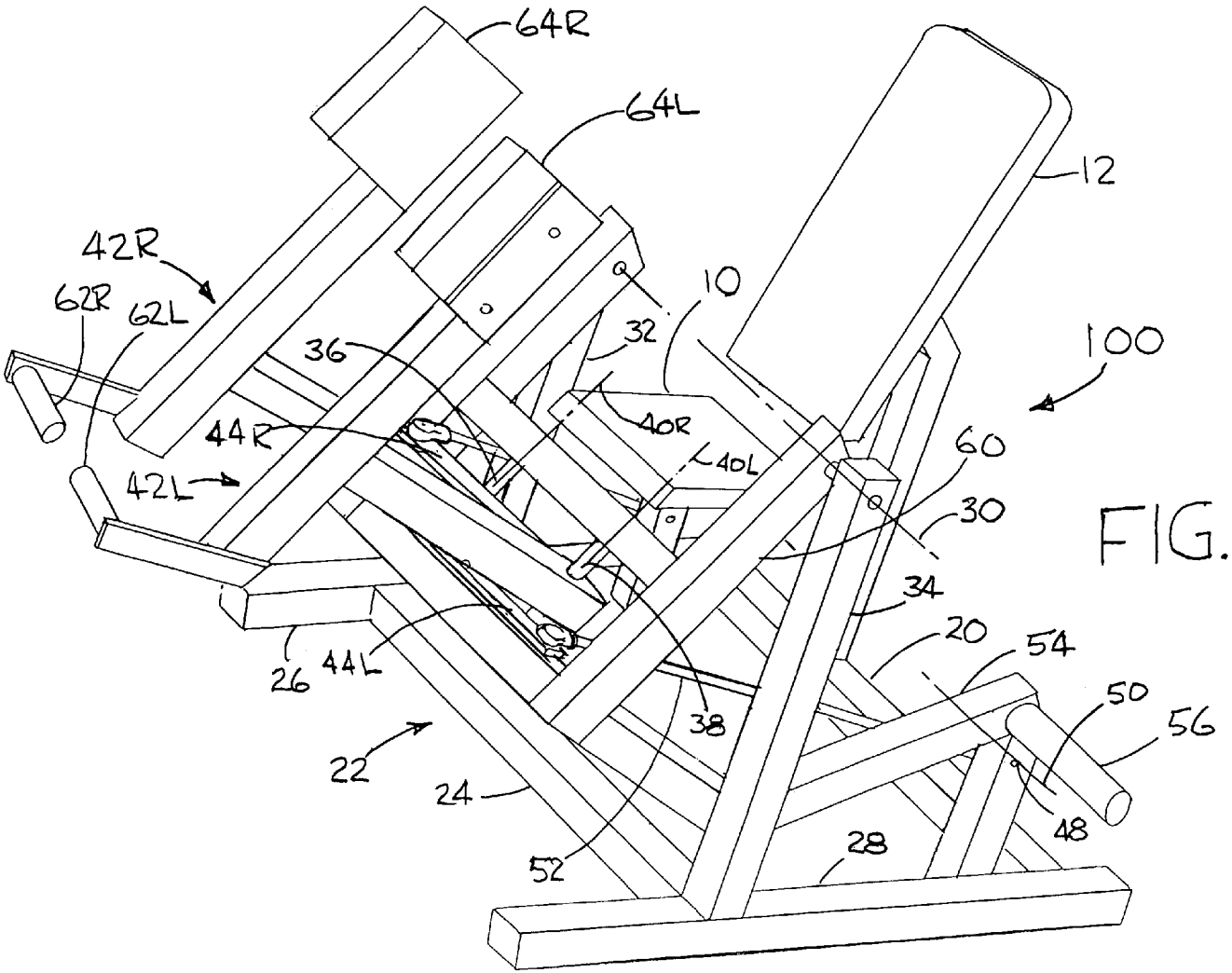
FIG. 1 is a perspective view of a preferred embodiment of an exercise machine for the gluteus muscle group according to the present invention.
Figure 2:
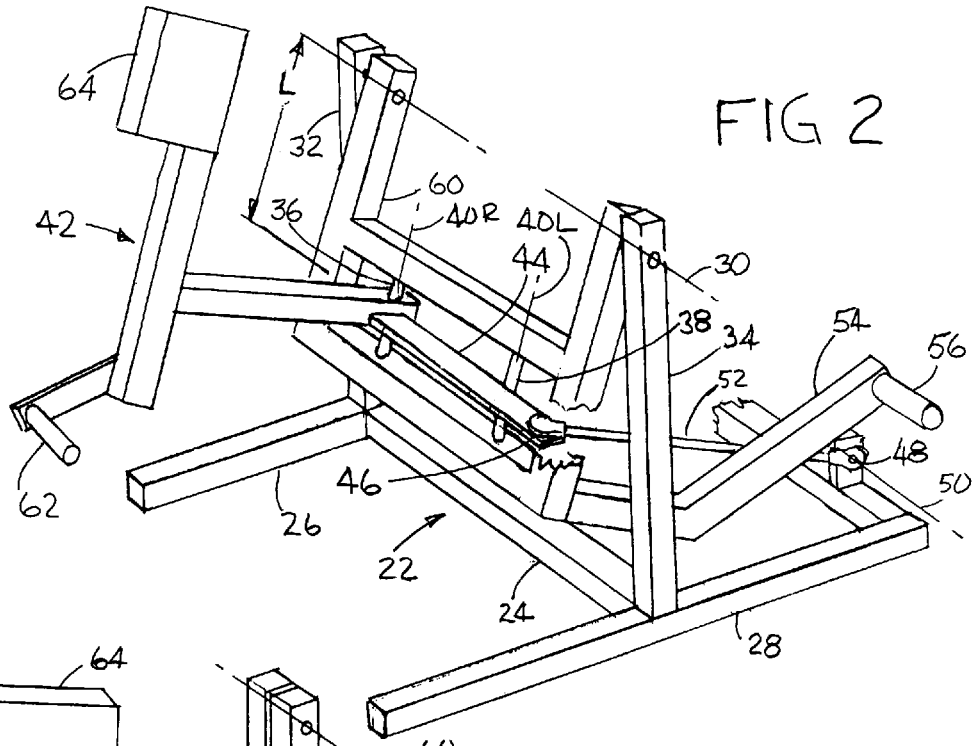
FIG. 2 is a partial side view of the operative elements of the embodiment of FIG. 1 as it appears in the passive, first position.
Figure 3:
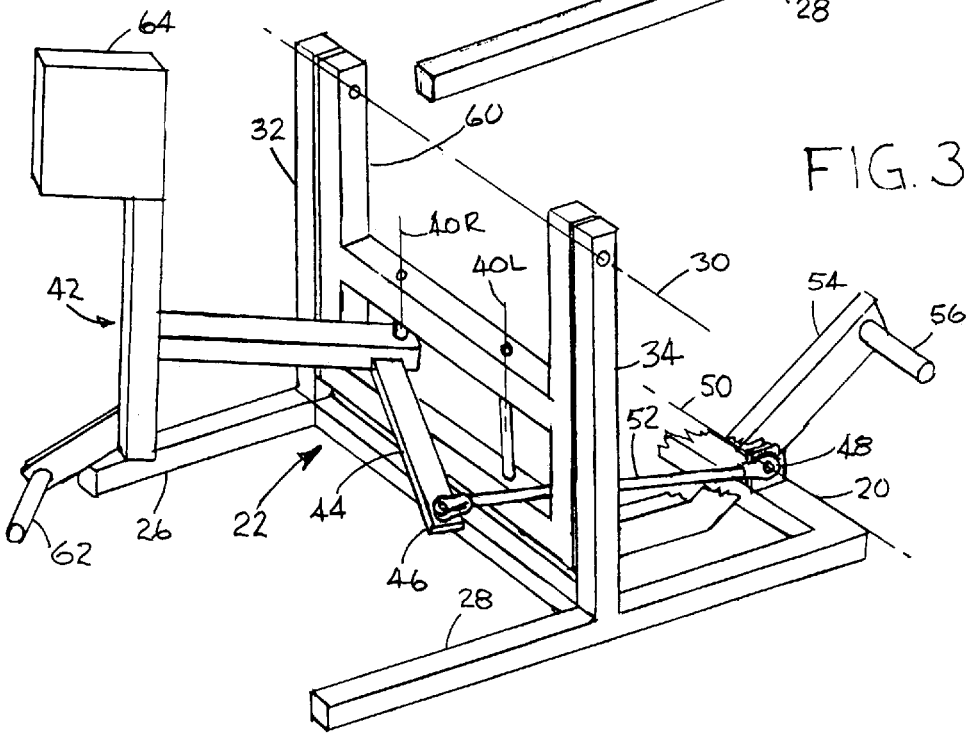
FIG. 3 is a partial side view of the operative elements of the embodiment of FIG. 1 as it appears in the active, second position.
Figure 4:
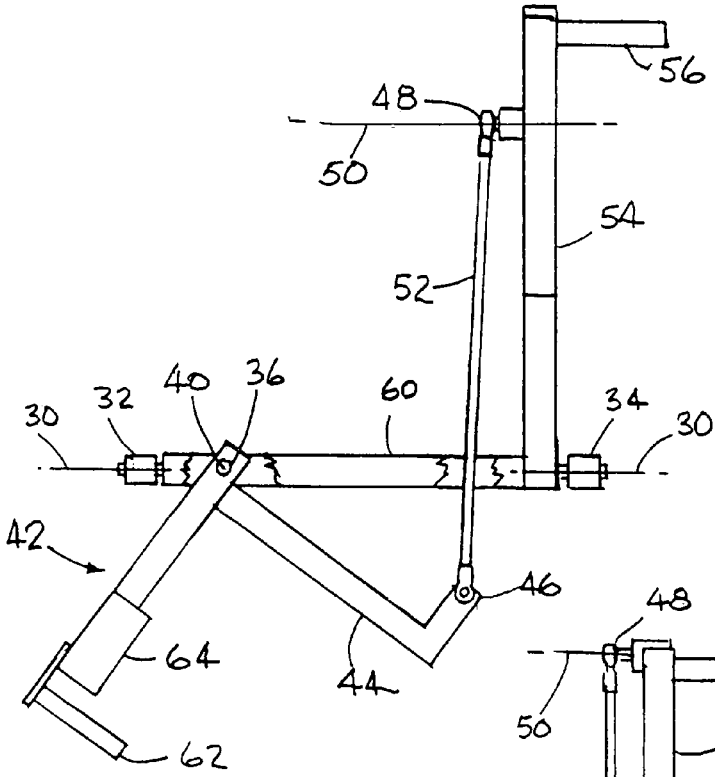
FIG. 4 is a partial plan view of the operative elements of the embodiment of FIG. 1 as it appears in the passive, first position.
Figure 5:
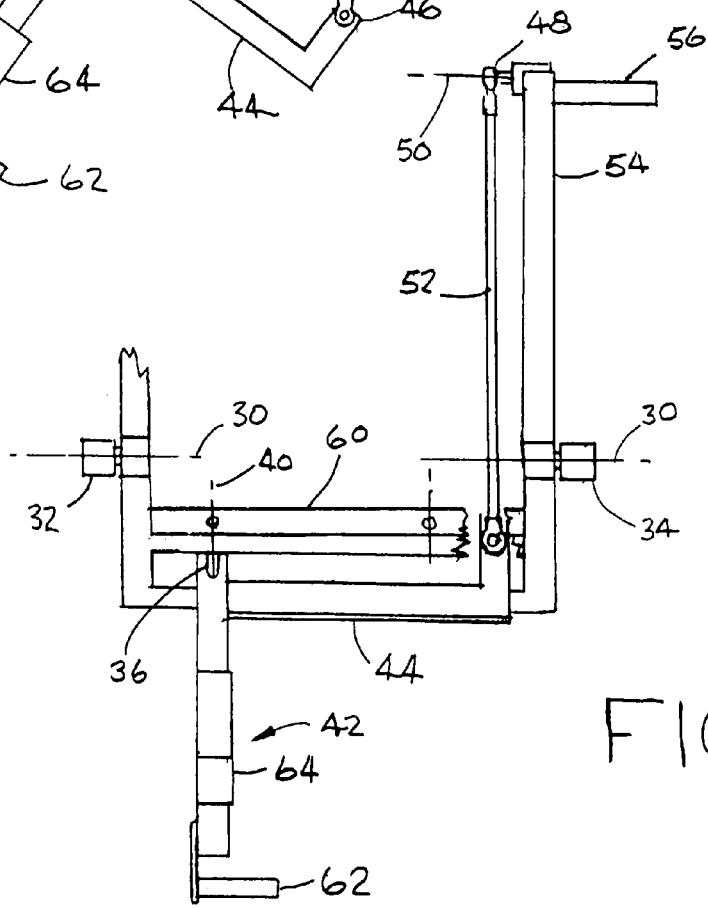
FIG. 5 is a partial plan view of the operative elements of the embodiment of FIG. 1 as it appears in the active, second position.

Referring now to FIG. 1, therein is illustrated a preferred embodiment of the present invention in exercise device 100. Seat 10 and seat back 12 are bisected by a vertical mid-plane that extends through the middle of main-frame 20. Thus, device 100 has two sides that are mirror images with respect to the vertical mid-plane.

The device 100 comprises a conventional main-frame 20 including a generally rectangular base 22 formed of standard rectangular steel tubing, an intermediate cross brace 24 perpendicularly disposed between an opposing right member 26 and left member 28 of the rectangular base 22. A pair of vertical column members 32 and 34 are rigidly fixed to the top of base 22 at cross brace 24. Pivotal connections 36 and 38, at the upper ends of column members 32 and 34, define horizontal axis 30.

A movable, "U" shaped sub-frame 60 is connected to main frame 20 at pivotal connections 36 and 38, so as to pivot about horizontal axis 30. Sub-frame 60 further includes a pair of substantially parallel pivot axes 40R and 40L. Axes 40R & 40L are generally perpendicular, but not necessarily at an angle of ninety degrees, and in a plane containing horizontal axis 30, and are axially displaced therefrom by a designed dimension "L". Right and left lever arm assemblies 42R and 42L are pivotally mounted at their proximal ends to sub-frame 60 at pivotal axes 40R and 40L respectively. Each lever arm assembly includes a positioning arm 44 extending radially from its respective pivot axis 40. Distal ends 46 of positioning arms 44 are connected to main frame 20 at connecting points 48 by ball-jointed connecting links 52. As a matter of symmetry connecting points 48 define a second horizontal axis 50.

As can be seen in FIGS. 2–5, rotation of sub-frame 60 about horizontal axis 30 acts through connecting links 52 to cause a similar pivotal movement of lever arm assemblies 42 about the respective right or left pivotal axis 40 and the converse is also true. Sub-frame 60 also includes rearwardly extending weight arm 54 with horn 56 for receiving barbell plates in selected increments of resistance for the exercise.

Left and right arm assemblies 42 each have an exercising force input location in the form of foot pedals 62R and 62L, oriented to effect pivotal movement of sub-frame 60 about horizontal axis 30, and a second exercising force input location in the form of leg or knee pads 64R and 64L, oriented to effect pivotal movement of right and left lever arm assemblies 42 about their respective right or left pivot axis 40. Pivot axes 40 are parallel, or symmetrically inclined, and lie in a plane with horizontal axis 30. A most significant aspect of the present invention is that axial displacement of pivotal axes 40 from horizontal axis 30 by the dimension "L" creates a moment arm about axis 30. The length of dimension "L" determines the force required at pads 64 relative to that at pedals 62. Rotation of sub-frame 60 about horizontal axis 30 acts through connecting links 52 to cause a similar pivotal movement of lever arm assemblies 42 about the respective pivotal axes 40. Thus, application of an exercising force at either input location 62 or 64, produces full-range pivotal movement of lever arm assembly 42 about both axes 30 and 40.

It is to be understood that the elements of the above-described invention used to create bi-directional exercise movements may be used in other configurations for exercise machines and is not limited to gluteus exercises. The principle of the invention may be applied to other lower and upper body exercise machines for pushing or pulling movements combined with lateral movement for compound exercise of various muscle groups. Although the preferred and alternative embodiments of the invention have been illustrated in the accompanying Drawings and described in the foregoing Detailed Description, it will be understood that the invention is not limited to the embodiments disclosed but is capable of numerous modifications within the scope of the claimed invention.

I claim:

1. Apparatus for bi-directional exercise movements having an incrementally set resistance, comprising:

a main frame including a substantially horizontal pivot axis;

a seat mounted on the main-frame;

a sub-frame pivotally mounted on the main-frame to pivot through an angular range about the horizontal axis, the sub-frame including a pair of spaced apart, symmetrically inclined, right and left pivot axes lying in a plane in a plane of the horizontal axis and axially displaced therefrom to provide a moment arm thereabout;

right and left lever arms having first and second ends wherein each first end is connected to the sub-frame for pivotal movement about the respective right or left pivot axis;

linkage members connecting each lever arm to the main-frame so that, as the sub-frame pivots through its angular range, the right and left lever arms each pivot through a similar range; and the lever arms each further including a pedal, oriented to effect pivotal movement of the sub-frame about the horizontal axis, and a knee pad, oriented to effect pivotal movement of the lever arms about the right and left axes, so that force applied to either a pedal or a knee pad will move the sub-frame and lever arms through their respective angular ranges.

2. Apparatus for bi-directional exercise movements comprising:

a main-frame;

a seat mounted on the main-frame;

a sub-frame pivotally mounted to the main-frame to pivot about a horizontal axis, the sub-frame including a pair of spaced apart and parallel, pivot axes, oriented substantially perpendicular to the horizontal axis but axially displaced therefrom to provide a moment arm thereabout;

a pair of lever arms, each having a first end pivotally connected to the sub-frame at one of the parallel pivot axes, a second end provided with a pedal as a first exercising force input location, for effecting movement of the lever arm about the horizontal axis, and a knee pad as a second exercising force input location, for effecting pivotal movement of the lever arm about the respective parallel pivot axis;

means for resisting the first and second exercise force inputs; and linkage connecting the lever arms to the main-frame, so that the first exercising force will force pivotal movement of the lever arms about the parallel pivot axes the second exercising force will force rotation of the sub-frame about the horizontal axis.

3. Apparatus providing adjustable resistance for bi-directional exercise movements comprising:

a frame;

a seat mounted on the main-frame;

a sub-frame pivotally mounted on the main-frame to pivot about a horizontal axis against the adjustable resistance, the sub-frame including a pair of spaced apart and symmetrically inclined second pivot axes, displaced from the horizontal axis to provide a moment arm thereabout;

a lever arm, including a pedal and a knee pad, mounted at its proximal end to the sub-frame at each second axis for pivotal movement thereabout and extending from each second axis so that a pedal and knee pad are positioned at each side of the seat;

a linkage connecting the lever arms to the main-frame, so as to compel the lever arms to pivot about their respective second axes as exercise force applied at the pedals rotates the sub-frame about the first horizontal axis; and the linkage likewise compelling the lever arms to pivot about the first horizontal axis as exercising force applied at the knee pads pivots the lever arms about their respective second axis.

4. A method for exercising muscle groups, so as to to effect movement in two angularly distinct directions, comprising the steps of:

providing a main-frame;

mounting right and left radially extending lever arms to the main-frame, each for pivotal movement in two angularly distinct directions;

providing a separate exercise force input location for effecting movement in each direction;

exerting exercising force against both force input locations of each arm simultaneously;

linking the angularly distinct direct movements together so that exercising force applied at one input location effects pivotal movement in both right and left angularly distinct directions; and resisting lever arm movement with a selected resistance force.

5. A method for exercising according to claim 4 and further comprising the steps of:

positioning the first exercising force input location for movement by the user's foot; and positioning the second exercising force input location for movement by the user's knee.

6. A method for for bi-directional exercising of a muscle group through movement of lever arms against a selected resistance comprising the steps of:

mounting a sub-frame for pivotal movement about a substantially horizontal axis;

mounting a lever arm to the sub-frame for pivotal movement about a second axis that is displaced from the horizontal axis so as to provide a moment arm thereabout; and linking the lever arm to the main-frame so that pivoting the subframe about the horizontal axis causes pivoting of the lever about the second axis; and pivoting the lever arm about the second axis causes pivoting of the subframe about the horizontal axis.

7. A method for exercising according to claim 6 and further comprising the steps of:

pivoting the sub-frame about the horizontal axis by applying a generally vertical exercising force with the user's foot; and pivoting the lever arm about the second axis by applying a generally lateral exercising force with the user's leg.

* * * * *